US008261729B2

(12) United States Patent
Laszlo et al.

(10) Patent No.: US 8,261,729 B2
(45) Date of Patent: Sep. 11, 2012

(54) SHUTTLECOCK LAUNCHING APPARATUS

(76) Inventors: Ivan Laszlo, Ste-Dorothee (CA); Herman Fischer, Ste-Dorothe (CA)

( * ) Notice: Subject to any disclaimer, the term of this patent is extended or adjusted under 35 U.S.C. 154(b) by 798 days.

(21) Appl. No.: 12/287,608

(22) Filed: Oct. 10, 2008

(65) Prior Publication Data

US 2009/0283088 A1 Nov. 19, 2009

(30) Foreign Application Priority Data

May 14, 2008 (CA) ..... 2631284

(51) Int. Cl.
*F41B 4/00* (2006.01)
*A63B 65/00* (2006.01)

(52) U.S. Cl. ..... 124/78; 124/6; 124/7; 124/51.1; 124/81; 124/82; 473/422; 473/579

(58) Field of Classification Search ..... 124/6–7, 124/51.1, 78, 81–82; 473/422, 579
See application file for complete search history.

(56) References Cited

U.S. PATENT DOCUMENTS 2,716,973 A * 9/1955 Desi ..... 124/78
4,262,648 A * 4/1981 Wegener et al. ..... 124/6
4,471,746 A * 9/1984 Ando ..... 124/6
4,648,596 A * 3/1987 Long ..... 473/419
4,672,942 A * 6/1987 Steward ..... 124/1
4,723,532 A * 2/1988 Osojnak ..... 124/78
4,834,060 A * 5/1989 Greene ..... 124/78
5,020,958 A * 6/1991 Tuttobene ..... 414/281
5,044,350 A * 9/1991 Iwabuchi et al. ..... 124/51.1
5,121,735 A * 6/1992 Hancock ..... 124/7
5,125,653 A * 6/1992 Kovacs et al. ..... 124/78
5,749,797 A * 5/1998 Sunseri et al. ..... 473/451
5,947,101 A * 9/1999 Kerr ..... 124/78
6,082,350 A * 7/2000 Crews et al. ..... 124/78
6,102,021 A * 8/2000 Sanders et al. ..... 124/78
6,443,140 B1 * 9/2002 Crews et al. ..... 124/78
6,505,577 B1 * 1/2003 Putnam ..... 119/702
6,715,478 B1 * 4/2004 Tanner ..... 124/16
6,752,138 B2 * 6/2004 Taryoto ..... 124/78
7,604,145 B2 * 10/2009 Percy ..... 221/95
7,806,788 B1 * 10/2010 Neuman ..... 473/451
7,841,950 B2 * 11/2010 Davidson et al. ..... 473/51
7,958,877 B2 * 6/2011 Lalor ..... 124/8
2003/0192522 A1 * 10/2003 Taryoto ..... 124/78
2004/0261778 A1 * 12/2004 Wilmot ..... 124/78
2005/0103319 A1 * 5/2005 Hudson et al. ..... 124/78
2005/0172943 A1 * 8/2005 Cucjen et al. ..... 124/6
2006/0118096 A1 * 6/2006 Cucjen et al. ..... 124/78
2006/0236993 A1 * 10/2006 Cucjen et al. ..... 124/78

* cited by examiner

*Primary Examiner* — Gene Kim
*Assistant Examiner* — Alexander Niconovich
(74) *Attorney, Agent, or Firm* — Eric Fincham

(57) ABSTRACT

A shuttlecock launching apparatus which comprises a storage for shuttlecocks, first and second launching wheels, a transfer assembly for transferring a single shuttlecock from the storage to the launching wheels, the transfer assembly being controlled by a cam wheel and cam follower which causes and guides the horizontal movement of the transfer assembly.

10 Claims, 8 Drawing Sheets

SHUTTLECOCK LAUNCHING APPARATUS

FIELD OF THE INVENTION

The present invention relates to an apparatus and more particularly, relates to a method and apparatus for the launching of shuttlecocks.

BACKGROUND OF THE INVENTION

Many sports utilize machines for performing a competitive movement in order to provide practice for its players. Thus, for example, in baseball, pitching machines are widely used to provide practice for the batters. The use of the machines permits the batter to practice without requiring a pitcher to throw the balls.

Similarly, in hockey, puck shooting machines can be utilized to provide practice to goalies. Tennis is another sport which utilizes a tennis ball launching machine in order to provide practice for the more inexperienced players.

In the game of badminton, it is also being proposed in the art to provide machines for launching shuttlecocks. One such machine is shown in U.S. Pat. No. 6,752,138 to Taryoto. In this machine, a plurality of shuttlecocks line up in a chute and the shuttlecocks are individually launched by a pair of spinning wheels. A feed mechanism comprises a motor driving a four spoke rotor.

SUMMARY OF THE INVENTION

It is an object of the present invention to provide a novel shuttlecock launching machine wherein shuttlecocks can be transported from a vertical storage tube to a pair of launching wheels which can launch the shuttlecocks in a wide range of trajectories.

According to one aspect of the present invention, there is provided a shuttlecock launching apparatus comprising a shuttlecock storage, first and second launching wheels, a transfer assembly for transferring a single shuttlecock from the shuttlecock storage to the launching wheels, the transfer assembly including a gripping device for holding and retaining a single shuttlecock, the shuttlecock assembly being on a vertically moveable base, the transfer assembly being horizontally moveable, a cam wheel and a cam follower, and the cam follower being connected to the transfer assembly to cause and guide the horizontal movement.

The shuttlecock storage is preferably a vertical tube wherein the shuttlecocks are store in a nested position as is known in the art. The inside of the tube is configured such that the lower most shuttlecock will drop into position with the base thereof being outside the tube such that it can be grasped. The remaining shuttlecocks are held in position due to the feathers.

The launching wheels may be of any suitable size and structure. Such launching wheels are known in the art. They may have a suitable gripping material extending about the periphery thereof.

Each of the launching wheels is preferably given by a separate motor such that, as desired, different speeds may be utilized in order to impart a desired trajectory to the shuttlecock. The launching wheels are also mounted (with their motor) such that they may pivot slightly when the shuttlecock is inserted between the wheels. A return means such as a spring member may be utilized.

The shuttlecock launching apparatus includes a transfer assembly which is designed to grip a single shuttlecock from the storage chamber and transfer the shuttlecock to a position where it is placed between the rotating launching wheels. To do this, there are two components—a horizontal component and a vertical component which operate to effect the transfer. Preferably, the vertical movement is guided by one or more guide poles with the horizontal movement being affected by a cam and cam follower arrangement. Preferably, both the horizontal and the vertical movements are driven by a single drive means which can use a belt to effect one of the drives.

The transfer device includes a gripping device which is designed to grasp a shuttlecock at the shuttlecock storage. To accomplish the same, a pair of gripper elements may have a configuration such that they are moved from a normally closed position to an opened position. Means for biassing the gripping elements towards a closed position may be utilized. Such means may comprise a spring member or the like.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
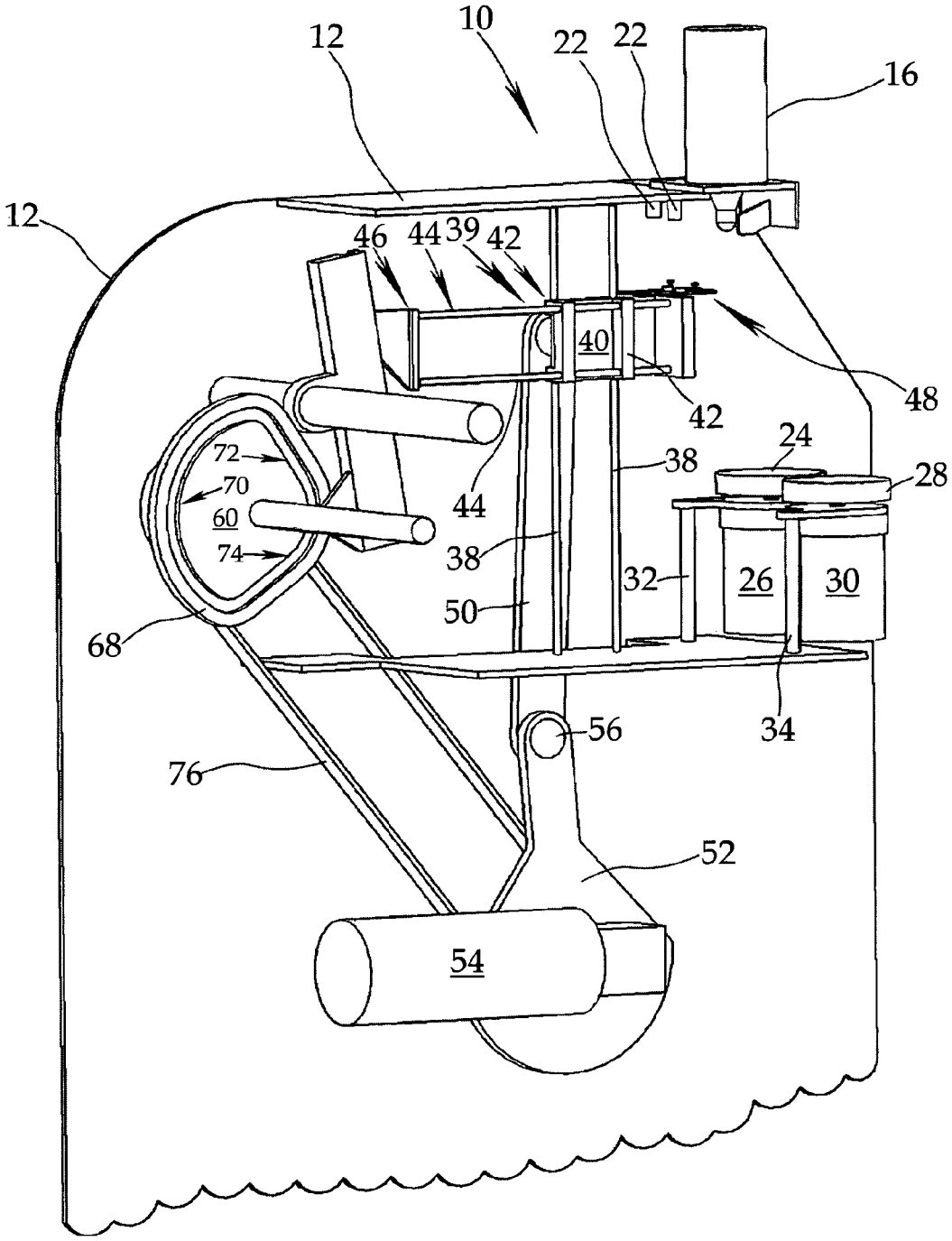
FIG. 1 is a perspective view of the shuttlecock launching apparatus according to the present invention.

Referring to the drawings in greater detail and by reference characters thereto, there is illustrated a shuttlecock launching apparatus which is generally designated by reference numeral 10. Shuttlecock launching apparatus 10 will include a suitable housing 12, only a portion of which is shown in the drawings. It will be understood that any suitable design and configuration of a housing may be utilized.

Mounted on top of housing 10 is a shuttlecock storage device generally designated by reference numeral 14. Shuttlecock storage device 14 comprises a feed tube 16 which is vertically oriented and into which a plurality of shuttlecocks may be placed. As may be seen in the drawings, each of shuttlecocks 15 is of a conventional design having a base portion 18 and feathers 20. Feathers 20 act to retain shuttlecock 15 within tube 16 until a positive force is applied thereto.

Extending downwardly from the top of housing 12 are a pair of fingers 22 for reasons which will become apparent hereinbelow.

Shuttlecock launching apparatus 10 also includes a first launching wheel 24 driven by a motor 26. Situated adjacent thereto is a second launching wheel 28 also driven by its own motor 30. Motors 26 and 30 are mounted on supports 32, 34 respectively such that they may move in a pivotal manner. A spring member 36 interconnects motors 26 and 30, again for reasons which will be explained hereinbelow.

A pair of vertical guide posts 38 are provided to receive a base member 40 forming a part of a transfer assembly which is generally designated by reference numeral 39. Base member 40 is mounted on vertical guide posts 38 and vertical guide posts 38 extend through cylindrical tube portions 42 of base member 40. Also extending outwardly from base member 40 are horizontal rods 44. At one end, horizontal rods 44 are secured to an attachment element 46 while at the opposed end thereof, there is provided a gripper assembly 48 which will be described in greater detail hereinbelow.

Transfer assembly 39 is moveable in a vertical direction by means of a post 50 which is pivotably connected to a drive wheel 52 at an outer circumferencial point thereof. Drive wheel 50 is driven by a suitable electric motor 54.

Shuttlecock launching apparatus 10 also includes a cam wheel generally designated by reference numeral 60 and which cam wheel 60 has a groove 68 designed to receive a cam follower 62. Cam follower 62 is connected to a first end of a pivot bar 64, which pivots about a pivot connection 66. Pivot bar 64 has, at the rear thereof, guide means for guiding attachment element 46. Conveniently, this may comprise a groove formed in pivot bar 64 with a complimentary projection on attachment element 46.

Groove 68 within cam wheel 60 has a first generally C-shaped section 70 which is connected at either end to two relatively straight sections 72 and 74. Naturally, the transition between straight sections 72, 74 and C-shaped section 70 is arcuate in nature.

Cam wheel 60 is rotatably driven about axle 78 by means of a drive belt 76 which is connected to drive wheel 52 driven by motor 54.

Figure 8C:
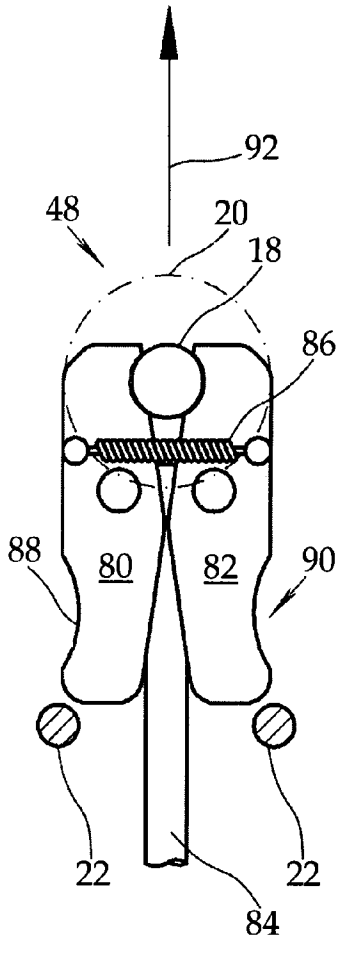
FIGS. 8A, 8B and 8C are sectional views showing the gripping mechanism as it grips a shuttlecock.
Figure 8B:
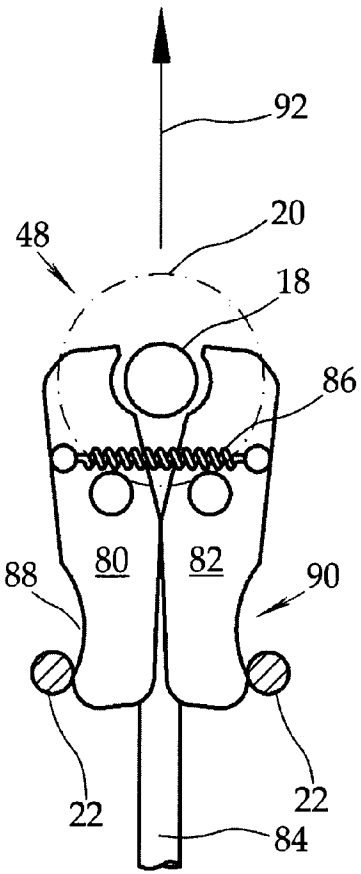
Figure 8A:
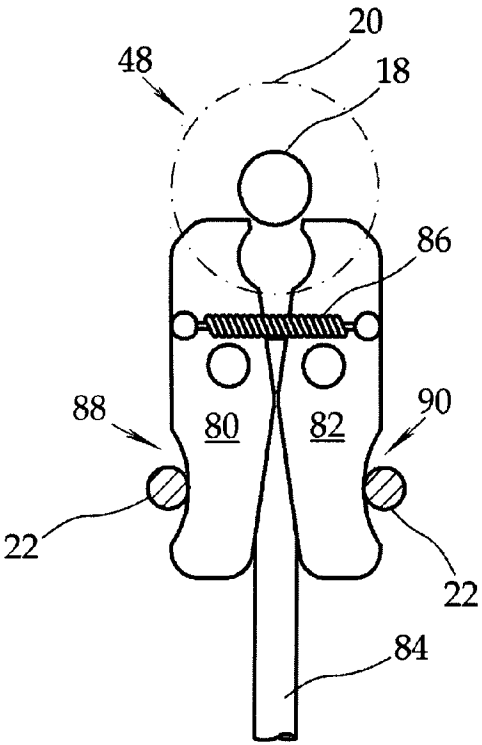

Gripper assembly 48 is illustrated in greater detail in FIGS. 8A to 8C. As shown, gripper assembly 48 comprises a pair of gripper elements 80 and 82. Gripper elements 80 and 82 are mounted on a support structure 84 and as seen, are connected by means of a spring 86.

Each gripper element 80, 82 has a concave recess 88, 90 respectively on an outer surface thereof.

Figure 2:
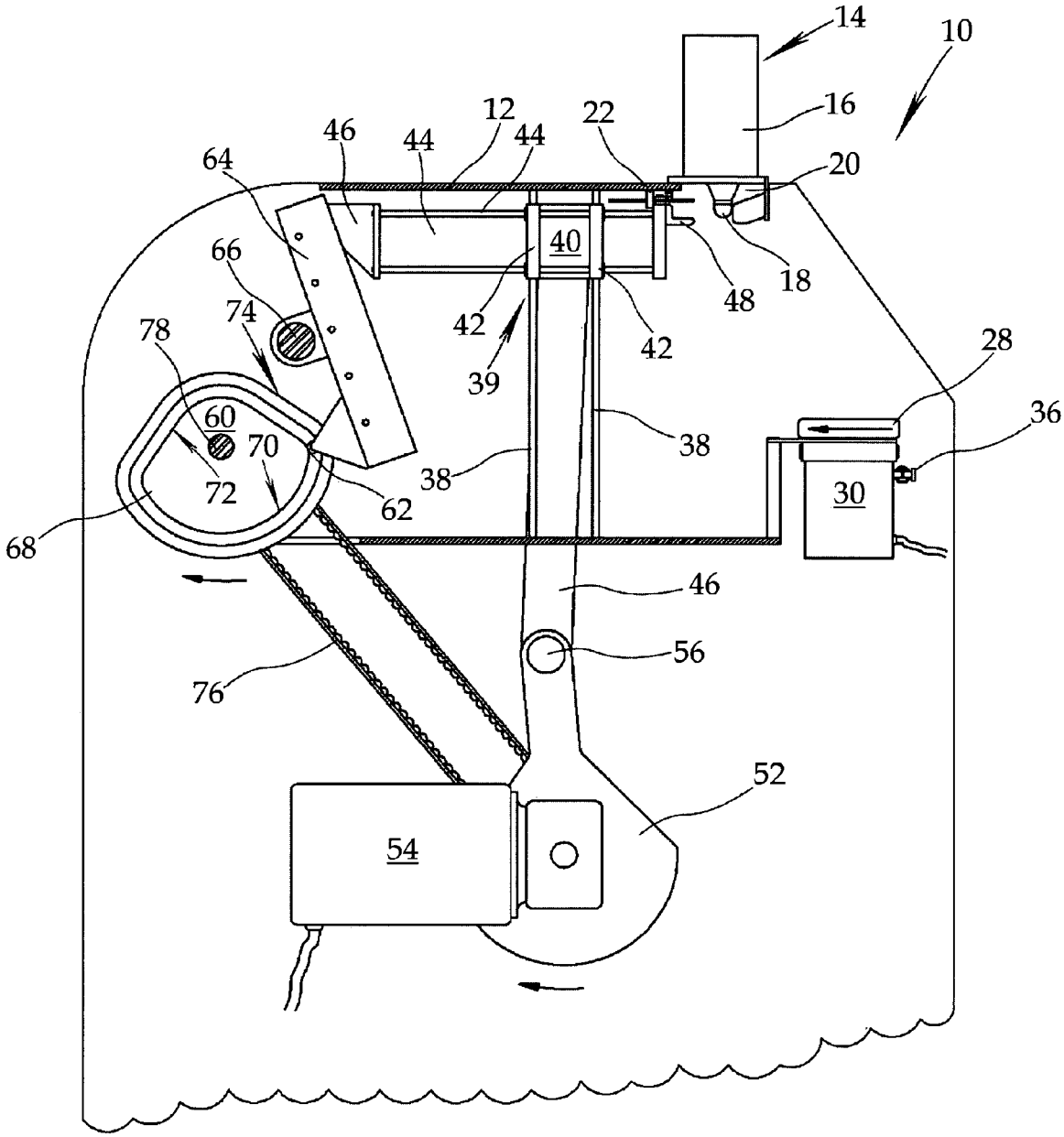
FIG. 2 is a side elevational view illustrating the shuttlecock launching apparatus in an initial position preparing to pick up a shuttlecock.

An initial operating position is illustrated in FIG. 2. In this position, transfer assembly 39 is at its upper most position with attachment element 46 being in a relatively straight position. Cam follower 62 is at the juncture of C-shaped section 70 and straight section 74. Pivot bar 64 is slightly angled.

Figure 3:
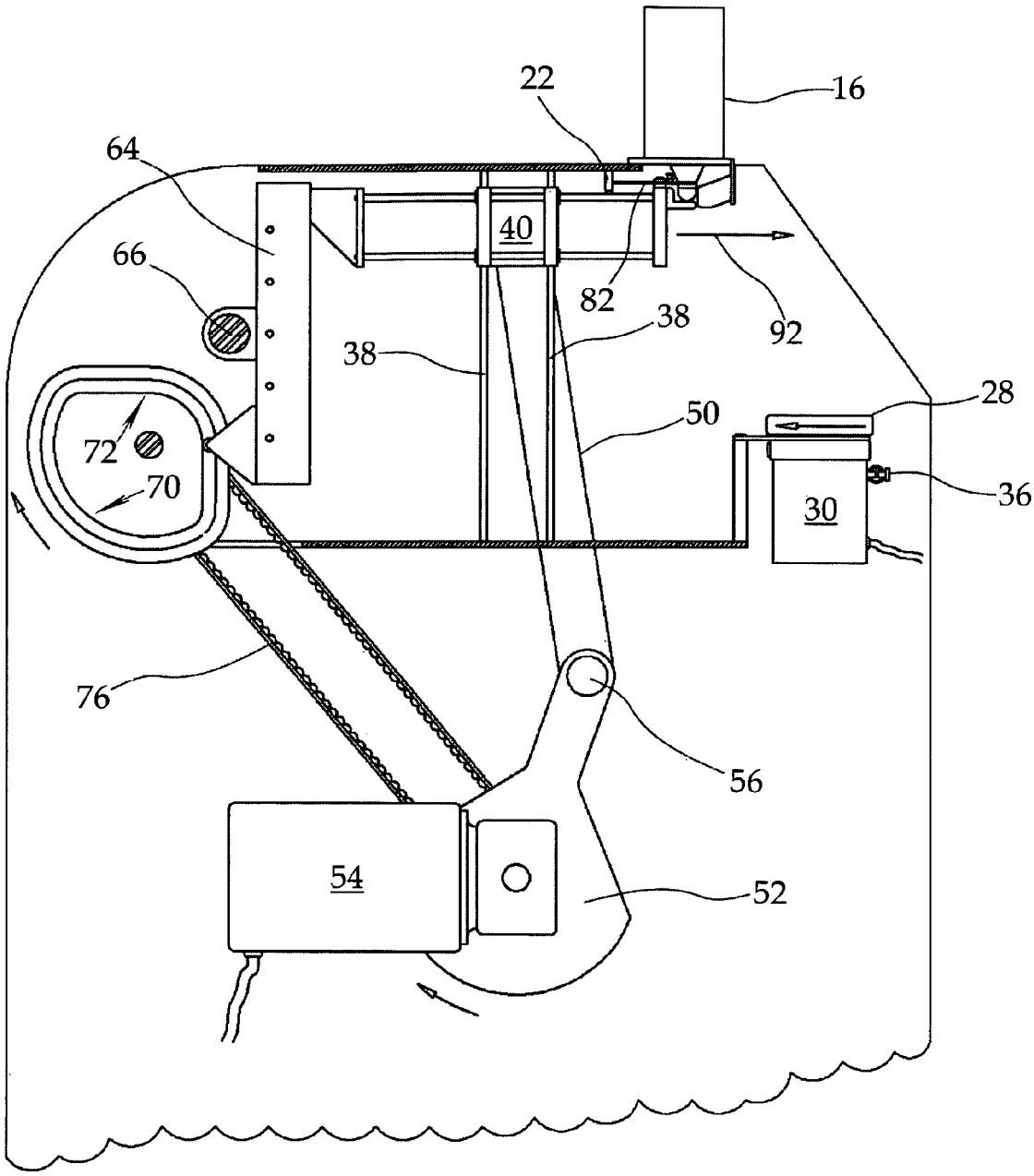
FIG. 3 is a view similar to FIG. 2 illustrating the gripping of a shuttlecock from a shuttlecock storage device.

Continued rotation of drive wheel 52 and cam wheel 60, as shown in FIG. 3, will bring pivot bar 64 into a more vertical position. This functions to move gripper assembly 48 into a position to grip a shuttlecock 15 as indicated by arrow 92.

The operation of the grippers is best seen in FIGS. 8A to 8C and will now be referred to. In the initial position of FIG. 2, fingers 22 are proximate the lowest point of concave recesses 88, 90. Continued movement causes gripper elements 80, 82 to open up as illustrated in FIG. 8B to thereby be in a position to grip base 18 of shuttlecock 15. Further movement, as seen in FIG. 8C, releases the pressure on gripper elements 80, 82 and spring 86 will bias the gripper elements together. The base 18 of shuttlecock 15 is then securely held.

Figure 4:
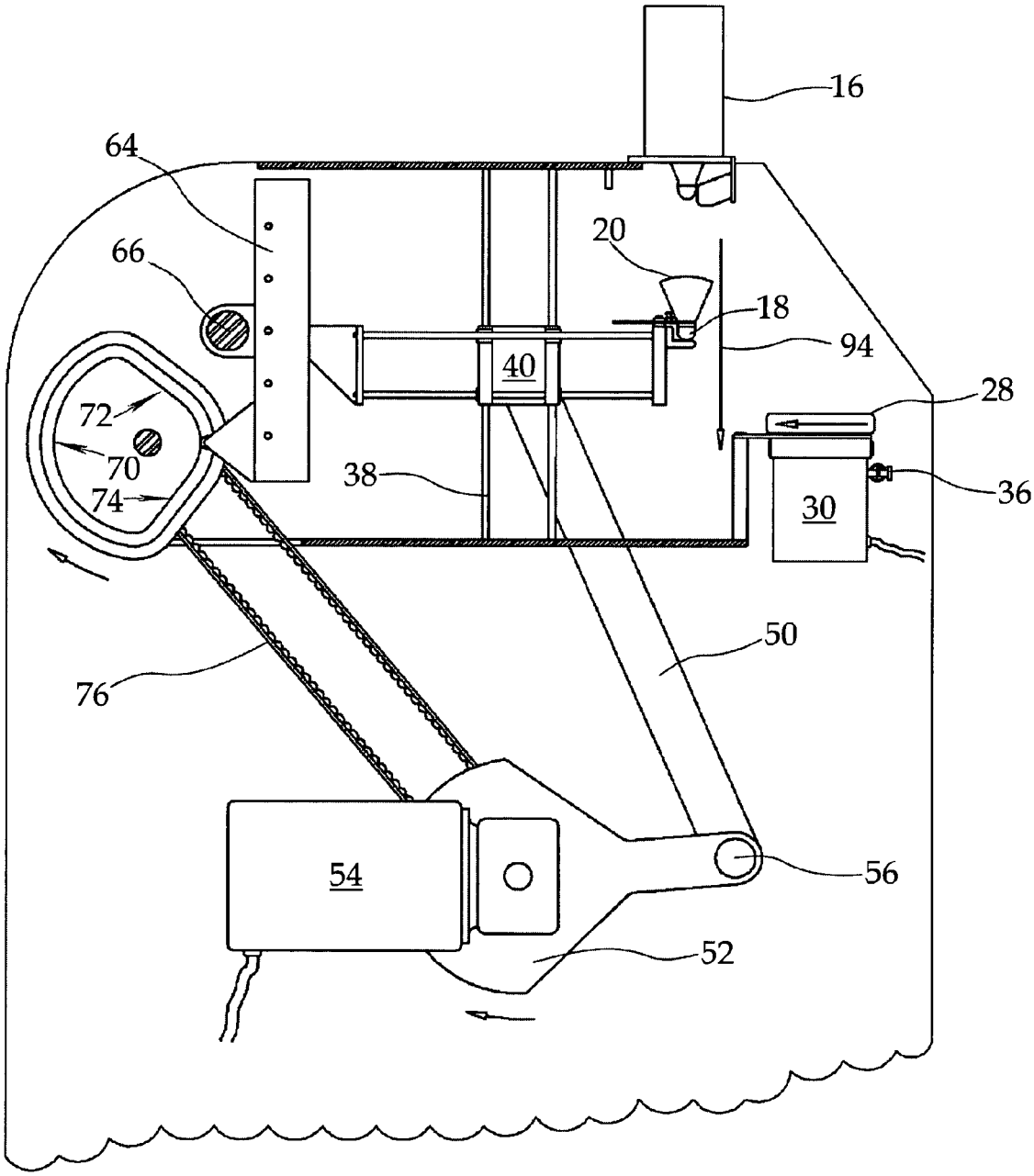
FIG. 4 is a side elevational view illustrating the downward transfer of a shuttlecock.

Further movement, as illustrated in FIG. 4, will cause attachment element 46 to lower transfer assembly 39 on vertical guide posts 38 as indicated by arrow 94.

Figure 5:
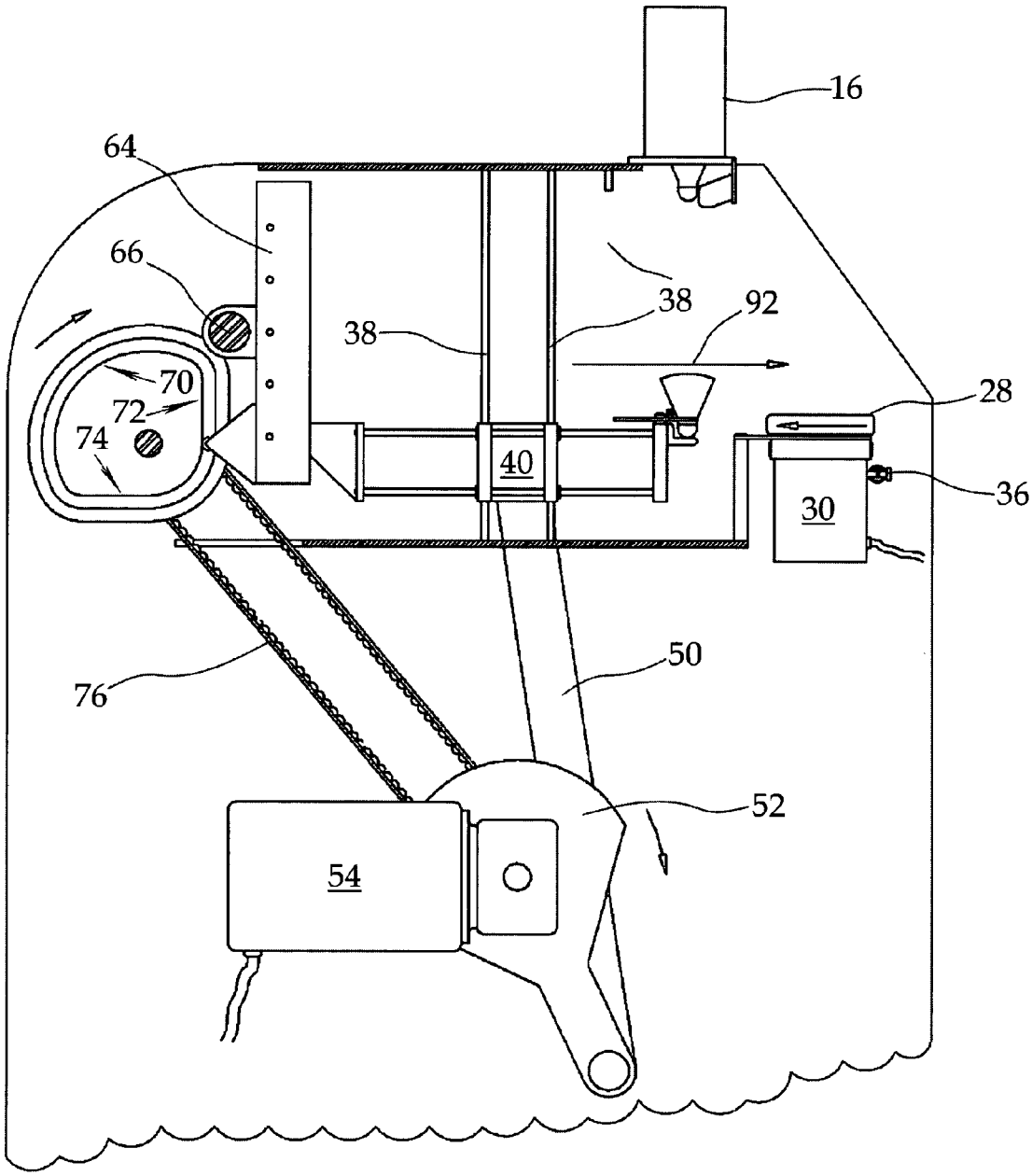
FIG. 5 is a side elevational view illustrating a shuttlecock being prepared to be placed between two launching wheels.

Further continued rotation, as illustrated in FIG. 5, will cause cam follower 62 to enter straight section 72 of cam wheel 60 and pivot bar 64 will remain in a substantially vertical position.

Figure 6:
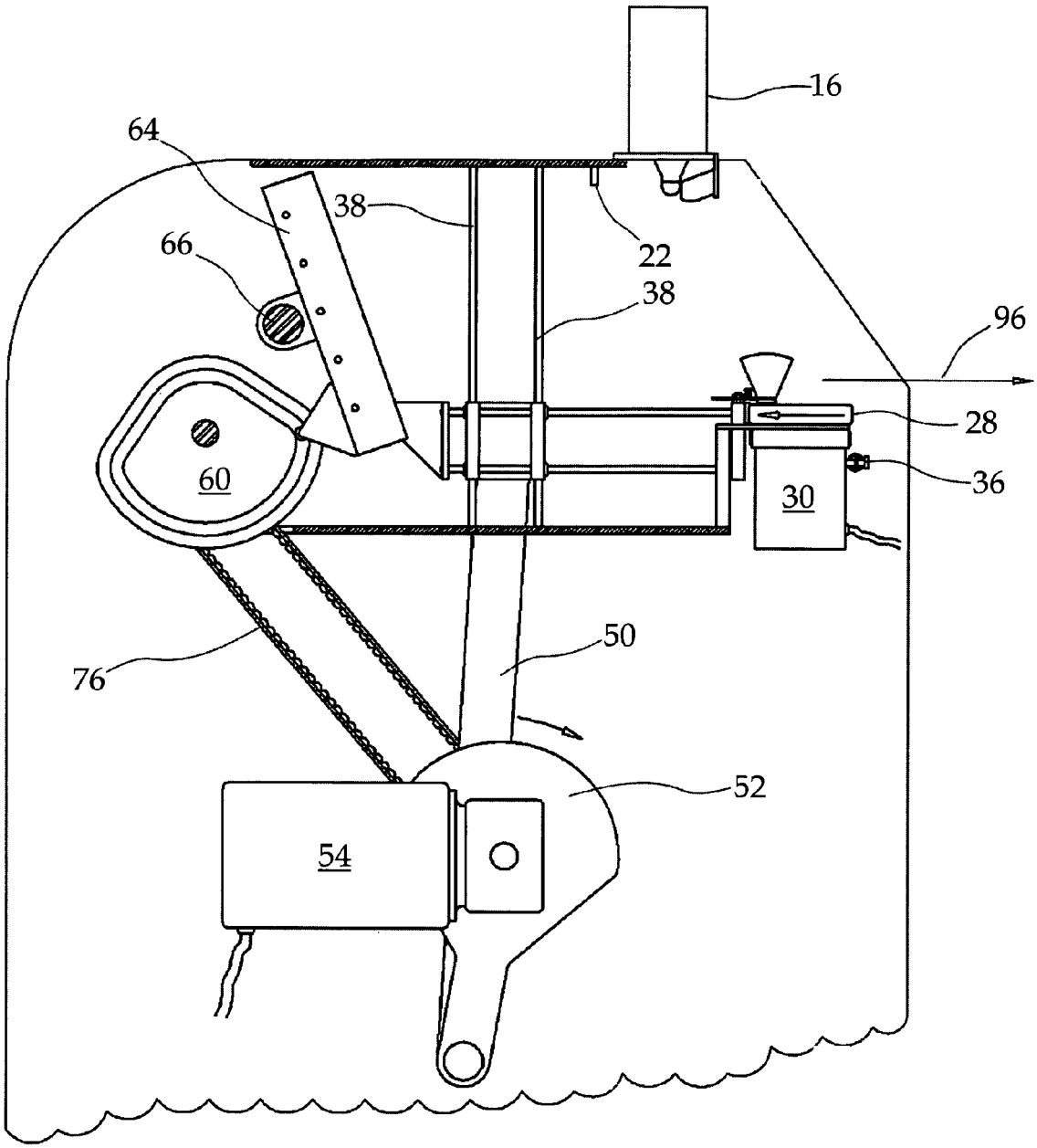
FIG. 6 is a side elevational view showing the shuttlecock placed between the launching wheels.
Figure 7:
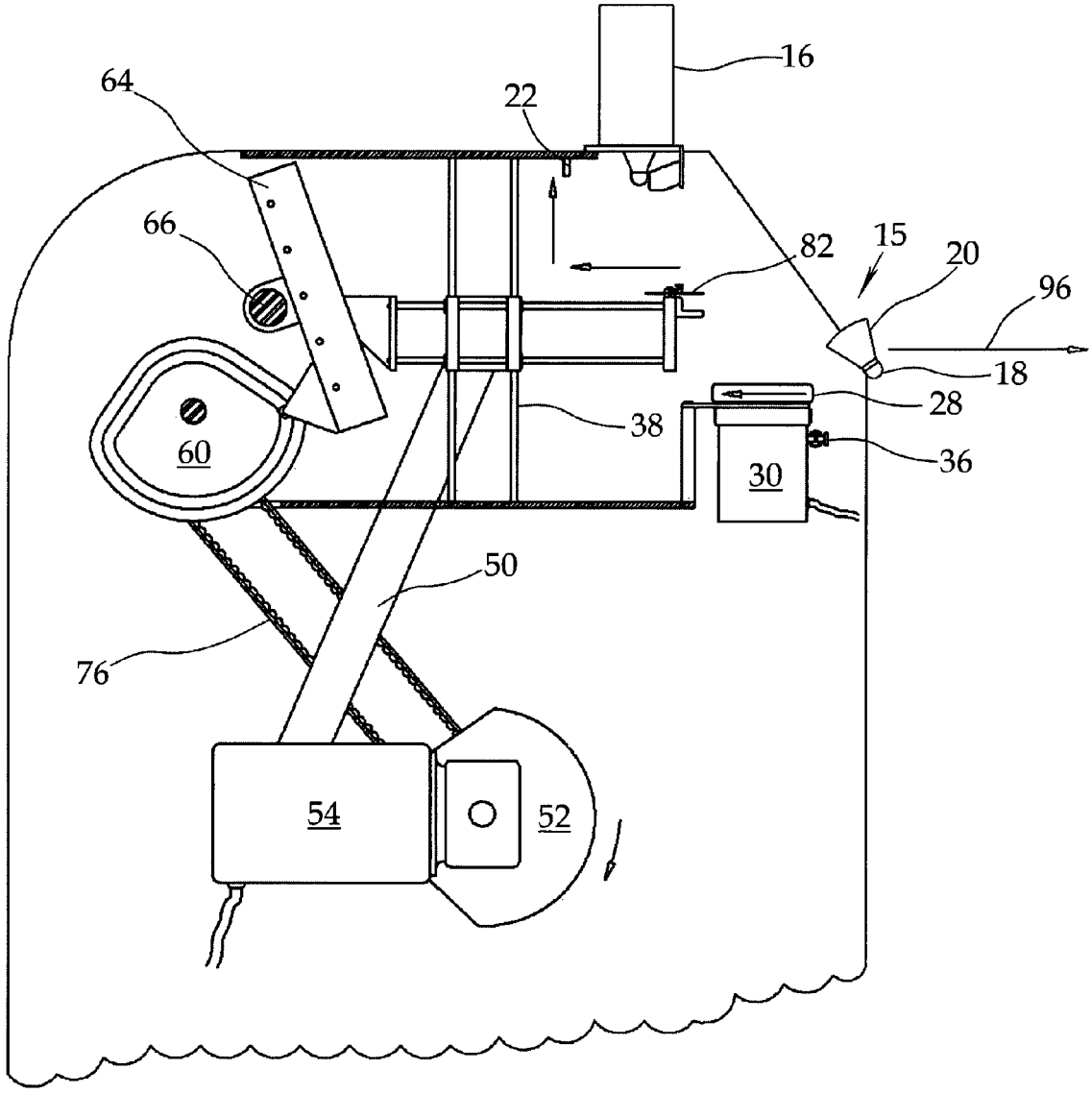
FIG. 7 is a side elevational view illustrating the launching of the shuttlecock and the movement of the transfer assembly back towards its initial position.

As shown in FIG. 6, continued rotation will cause pivot bar 64 to again move to a diagonal position and position base 18 of shuttlecock 15 in a position to be gripped by launching wheels 24, 28. Shuttlecock 15 is then ejected as indicated by arrow 96. Finally, the transfer assembly then returns to its initial position as shown in FIG. 7.

Naturally, the shuttlecock launching apparatus will include controls to control the various components of the apparatus. Thus, suitable controls may be provided for the motors to vary the speed thereof.

Various adjustments or controls may be incorporated to provide a control over the trajectory. Thus, the relative speeds of the launching wheels 24 and 28 may be varied. Also, the plane of the launching wheels may be varied; still further, one or more deflectors may be utilized to control the path of the shuttlecock.

It will be understood that the above described embodiment is for purposes of illustration only and changes and modifications may be made thereto without departing from the spirit and scope of the invention.

We claim:

1. A shuttlecock launching apparatus comprising:
- a shuttlecock storage;
- first and second launching wheels;
- a transfer assembly for transferring a single shuttlecock from said shuttlecock storage to said launching wheels;
- said transfer assembly including a gripping device for holding and retaining a single shuttlecock;
- said transfer assembly being mounted on a vertically moveable base;
- said entire transfer assembly being horizontally and vertically movable relative to said launching wheels and said shuttlecock storage;
- a cam wheel and a cam follower; and
- said cam follower being connected to said transfer assembly to cause and guide said horizontal movement.

2. The assembly of claim 1 wherein said vertically moveable base is mounted on a pair of vertically extending posts, said vertical movement being guided by said vertically extending posts.

3. The assembly of claim 1 wherein said cam wheel is mounted for rotatable movement, said cam wheel including a cam recess for receiving said cam follower, said cam recess having a first portion of a generally C-shaped configuration and second and third portions of a substantially linear configuration connected to said C-shaped portion and to each other.

4. The apparatus of claim 1 further including an electric drive motor, said electric drive motor being operative to drive said transfer assembly through both said vertical movement of said base and said horizontal movement.

5. The apparatus of claim 1 wherein said cam follower is connected to a pivot bar, said pivot bar being pivotably mounted, said cam follower being located at one end thereof, a second end thereof being connected to said transfer assembly.

6. The apparatus of claim 1 wherein said gripping device comprises a pair of gripper elements, said gripper elements being moveable from an opened position to a closed position, said gripper elements being biased to a normally closed position.

7. The apparatus of claim 6 wherein said gripper elements have an arcuate surface, means on said machine to move said gripper elements to an opened position when proximate said shuttlecock storage.

8. The apparatus of claim 1 wherein said launching wheels are pivotably mounted, a spring member extending between said launching wheels.

9. The apparatus of claim 8 wherein each of said launching wheels is independently driven.

10. The apparatus of claim 9 further including a pivot bar said pivot bar being pivotably connected, a first end of said pivot bar being connected to said cam follower, a second end of said pivot bar being connected to said transfer assembly, whereby movement of said cam wheel causes said transfer assembly to move horizontally.

* * * * *